US005192072A

United States Patent [19]

Hong

[11] Patent Number: 5,192,072

[45] Date of Patent: Mar. 9, 1993

[54] GAME RACKET HAVING IMPROVED STRINGING MEANS

[76] Inventor: Arthur Hong, No. 96, Sec. 4, Pei-Ping Rd., Taichung City, Taiwan

[21] Appl. No.: 872,380

[22] Filed: Apr. 23, 1992

[51] Int. Cl.[5] ..... A63B 49/02; A63B 51/10

[52] U.S. Cl. ..... 273/73 C; 273/73 D

[58] Field of Search ..... 273/73 R, 73 A, 73 B, 273/73 C, 73 D, 73 E

[56] References Cited

U.S. PATENT DOCUMENTS

| | | | |
|---|---|---|---|
| 1,502,845 | 7/1924 | Blache | 273/73 D |
| 3,968,966 | 7/1976 | D'Aquanni | 273/73 D |
| 4,049,269 | 9/1977 | Blackburne | 273/73 D |
| 4,076,241 | 2/1978 | Newsome | 273/73 D |
| 4,141,549 | 2/1979 | Hayes et al. | 273/73 D X |
| 4,204,680 | 5/1980 | Blackburne | 273/73 D |
| 4,802,678 | 2/1989 | Svoma | 273/73 D |

FOREIGN PATENT DOCUMENTS

| | | | |
|---|---|---|---|
| 3018354 | 11/1981 | Fed. Rep. of Germany | 273/73 D |
| 4010722 | 10/1991 | Fed. Rep. of Germany | 273/73 D |
| 1212195 | 10/1959 | France | 273/73 D |

*Primary Examiner*—V. Millin
*Assistant Examiner*—William E. Stoll
*Attorney, Agent, or Firm*—Browdy and Neimark

[57] ABSTRACT

The racket head frame is provided with a predetermined number of recess cuts, each of which is used to receive therein a stringing tube of stringing element of plastic material. The stringing element has two shoulders for use in shielding both stringing tube and the surface of the racket head frame. Two stringing tubes located respectively and correspondingly on the two shoulders are coupled by means of a connection portion, which serves to shield both the string and the side surface of the racket head frame.

2 Claims, 5 Drawing Sheets

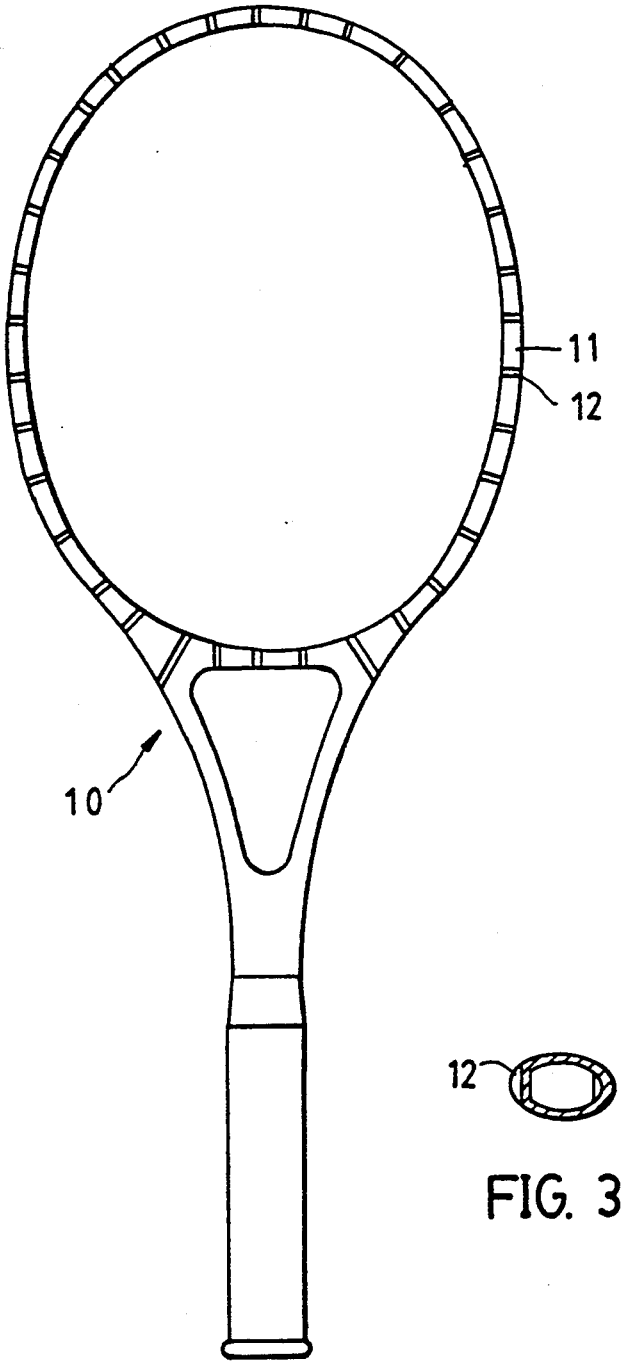
FIG. 1
FIG. 3
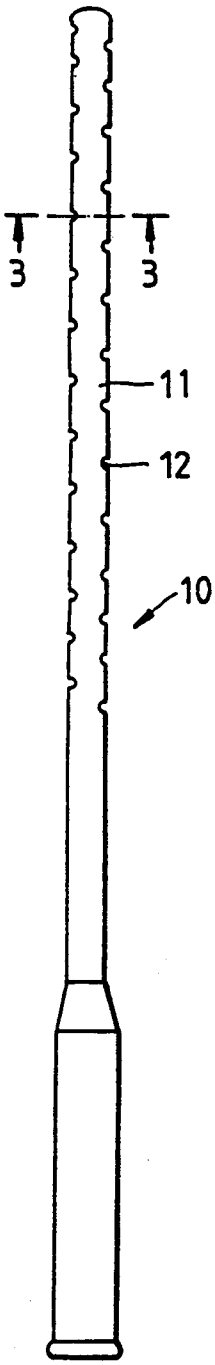
FIG. 2

GAME RACKET HAVING IMPROVED STRINGING MEANS

BACKGROUND OF THE INVENTION

The present invention relates to a sports racket, and more particularly to stringing means of a sports racket made of composite material.

As exemplified by Martel in the French Patent 2276845 and Svoma in the U.S. Pat. No. 4,802,678, various attempts have been made to improve the stringing means of a sports racket. They all disclose sports racket frames, which are reinforced by means of an additional thickness added thereto and are composed of two parallel rows of string holes permitting strings to pass therethrough in such manners that strings form a greater sweet spot and that the portions of the strings adjacent to the frame are arranged obliquely so as to enhance the ball-controlling capability of the sports racket. However, it must be noted here that the stringing designs described above can bring about the expected effect only when two rows of string holes are arranged as far apart as possible. Such arrangement of string holes results in a greater distance between the netted surface and the edge of the racket head frame. As a result, the ball-controlling capability of the racket is greatly compromised.

SUMMARY OF THE INVENTION

It is therefore the primary objective of the present invention to provide an improved stringing means of a sports racket made of composite material, which does not involve construction of string holes so as to enhance the strength of the racket.

It is another objective of the present invention to provide an improved stringing means of a sports racket made of composite material, which brings about a relatively short distance between the netted surface and the edge of the head frame so as to enhance the ball-controlling capability of the racket.

In keeping with the principles of the present invention, the foregoing objectives of the present invention are accomplished by an improved stringing means of sports racket made of composite material and provided with a head frame, a hand grip, and a shaft located between the head frame and the hand grip. The head frame consists of a predetermined number of stringing elements, which permit strings to pass therethrough to form a netted surface in such a manner that each of the strings passes each of the stringing elements to form two turning points located respectively at two opposite sides of the center line of the outer frame of the head frame. The line connecting these two turning points is such that it meets the center line obliquely. The front face and the rear face of the netted surface so formed have respectively a plan portion surrounded by a predetermined number of bevels, each of which forms a predetermined angle with the plan portion and has a perimeter connecting with the plan portion and the stringing element. The inclined plane of the angle so formed extends outwardly and upwardly. The head frame is characterized in that it comprises a predetermined number of recess cuts located respectively at the front face and the rear face of the head frame. Each stringing element has two shoulders parallel to each other and a predetermined number of stringing tubes. Those two stringing tubes located respectively and correspondingly on the two shoulder are coupled by means of a connection portion. The stringing elements are disposed in such manners that their stringing tubes are inserted into the recess cuts and that their connection portions cover the side surface of the head frame.

The foregoing objectives, functions, and features of the present invention will be better understood by studying the following detailed description of two preferred embodiments of the present invention, in conjunction with the drawings provided herewith.

BRIEF DESCRIPTION OF THE DRAWINGS

FIG. 1 shows a front elevational view of a first preferred embodiment of the present invention, which is not provided with stringing elements.

FIG. 2 is a side view of the first preferred embodiment of the present invention as shown in FIG. 1.

FIG. 3 shows a sectional view of the portion taken along the line 3—3 as shown in FIG. 2.

DETAILED DESCRIPTION OF THE PREFERRED EMBODIMENTS

Referring to FIGS. 1-8, a racket 10 of the first preferred embodiment of the present invention is made of carbonaceous fiber preimpregnated in epoxy resin and is composed of a head frame 11 having a predetermined number of recess cuts 12. The method of making the racket 10 has been disclosed by this inventor in a pending U.S. patent application bearing a Ser. No. of 07-739366. It is beyond the scope of the present invention and will not be therefore further expounded here.

Figure 5:
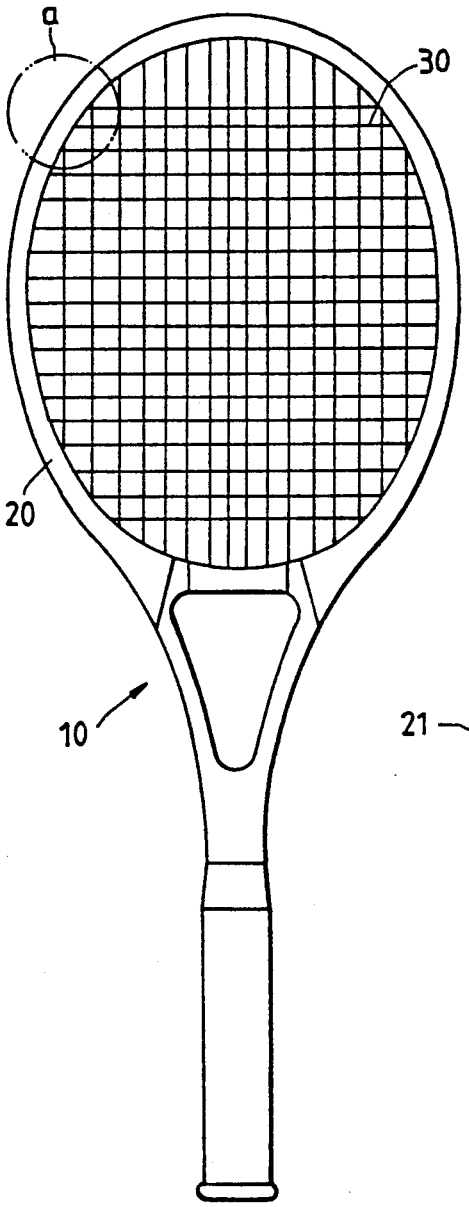
FIG. 5 shows a front elevational view of the first preferred embodiment of the present invention.
Figure 8:
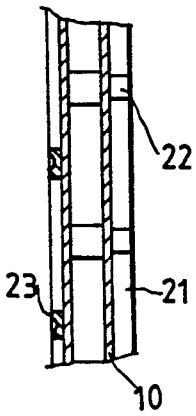
FIG. 8 shows a sectional view of the portion taken along the line 8—8 as shown in FIG. 6.
Figure 7:
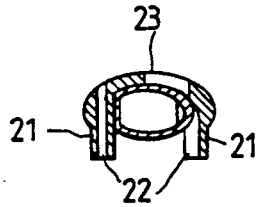
FIG. 7 shows a sectional view of the portion taken along the line 7—7 as shown in FIG. 6.
Figure 6:
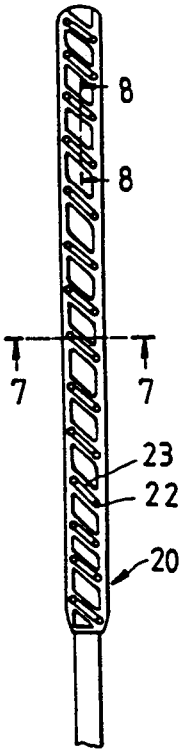
FIG. 6 is a side view of the first preferred embodiment of the present invention as shown in FIG. 5.
Figure 4:
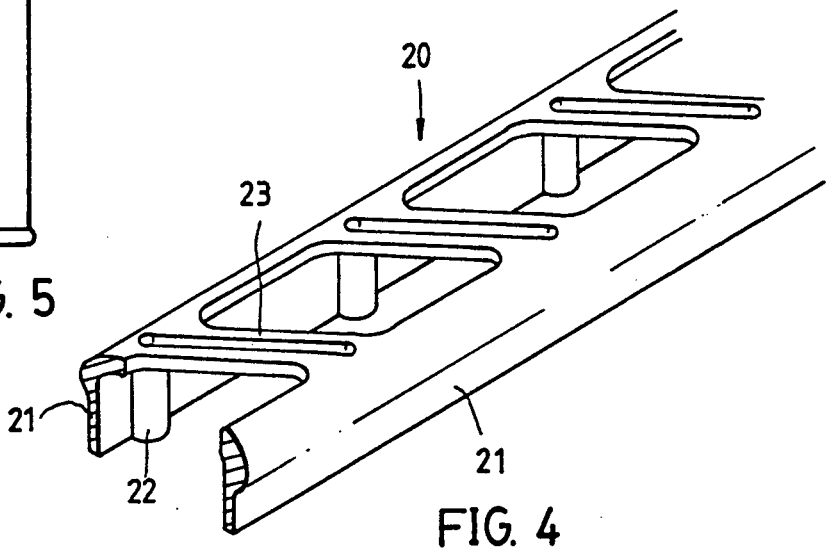
FIG. 4 shows a three-dimensional view of the stringing element of the first preferred embodiment of the present invention.
Figure 9:
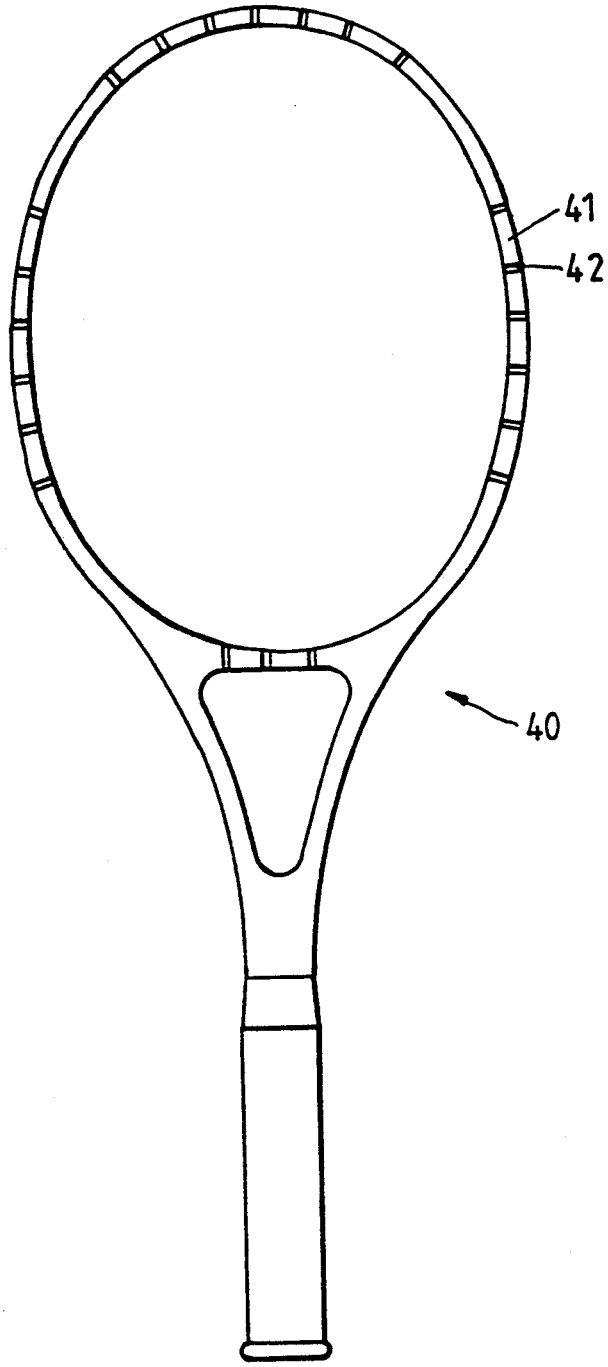
FIG. 9 shows a front elevational view of a second preferred embodiment of the present invention, which is not provided with the stringing elements.
Figure 10:
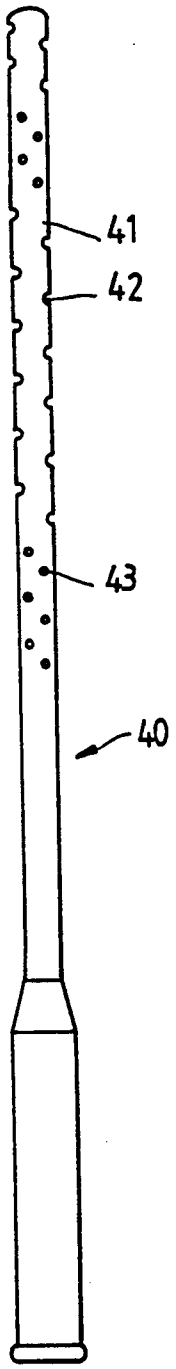
FIG. 10 is a side view of the second preferred embodiment of the present invention as shown in FIG. 9.
Figure 11:
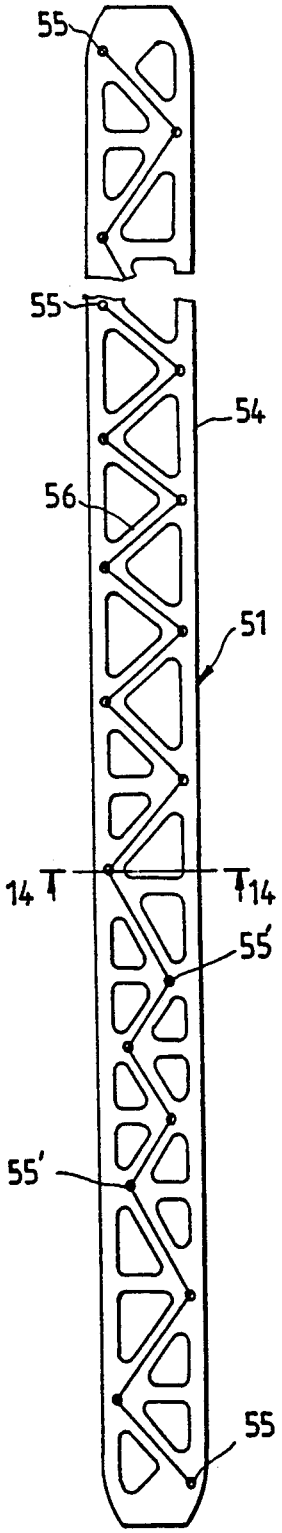
FIGS. 11-13 show plan views of stringing elements of the second preferred embodiment of the present invention.
Figure 12:
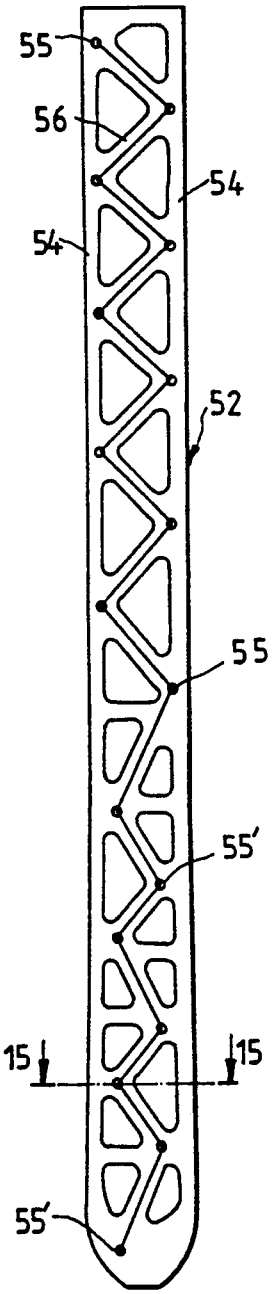
Figure 13:
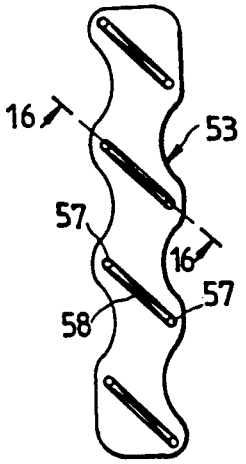

As shown in FIG. 4, a stringing element 20 has two shoulders 21 parallel to each other. A predetermined number of stringing tubes 22 are arranged along a direction of short axis in the inner side of the shoulder 21. The two stringing tubes 22 located at corresponding positions of the two shoulders 21 are coupled with a connection portion 23. It must be noted here that the connection portions 23 so constructed are arranged in an obliquely parallel manner, as shown in FIG. 4.

In the process of combining the stringing elements 20 with the head frame 11 of the racket 10, each stringing tube 22 of the stringing element 20 is inserted into the recess cut 12 of the head frame 11 in such a manner that the connection portion 23 covers the side surface of the head frame 11. The netted surface of the racket 10 is formed by strings 30, each of which passes a stringing tube 22 and a shallow groove of connection portion 23 and another stringing tube 22. The stringing tube 22 and the connection portion 23 work as shields to prevent the string 30 from rubbing against the head frame 11.

Now referring to FIGS. 9–17, a racket 40 of the second preferred embodiment of the present invention is shown comprising a head frame 41 having a predetermined number of recess cuts 42 and a predetermined number of through holes 43 located respectively at the positions corresponding to one, five, seven and eleven of the clock.

Figure 14:
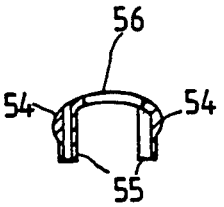
FIG. 14 is a sectional view of the portion taken along the line 14—14 as shown in FIG. 11.
Figure 15:
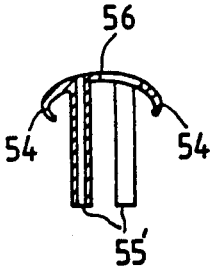
FIG. 15 is a sectional view of the portion taken along the line 15—15 as shown in FIG. 12.
Figure 16:
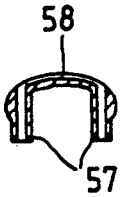
FIG. 16 is a sectional view of the portion taken along the line 16—16 as shown in FIG. 13.
Figure 17:
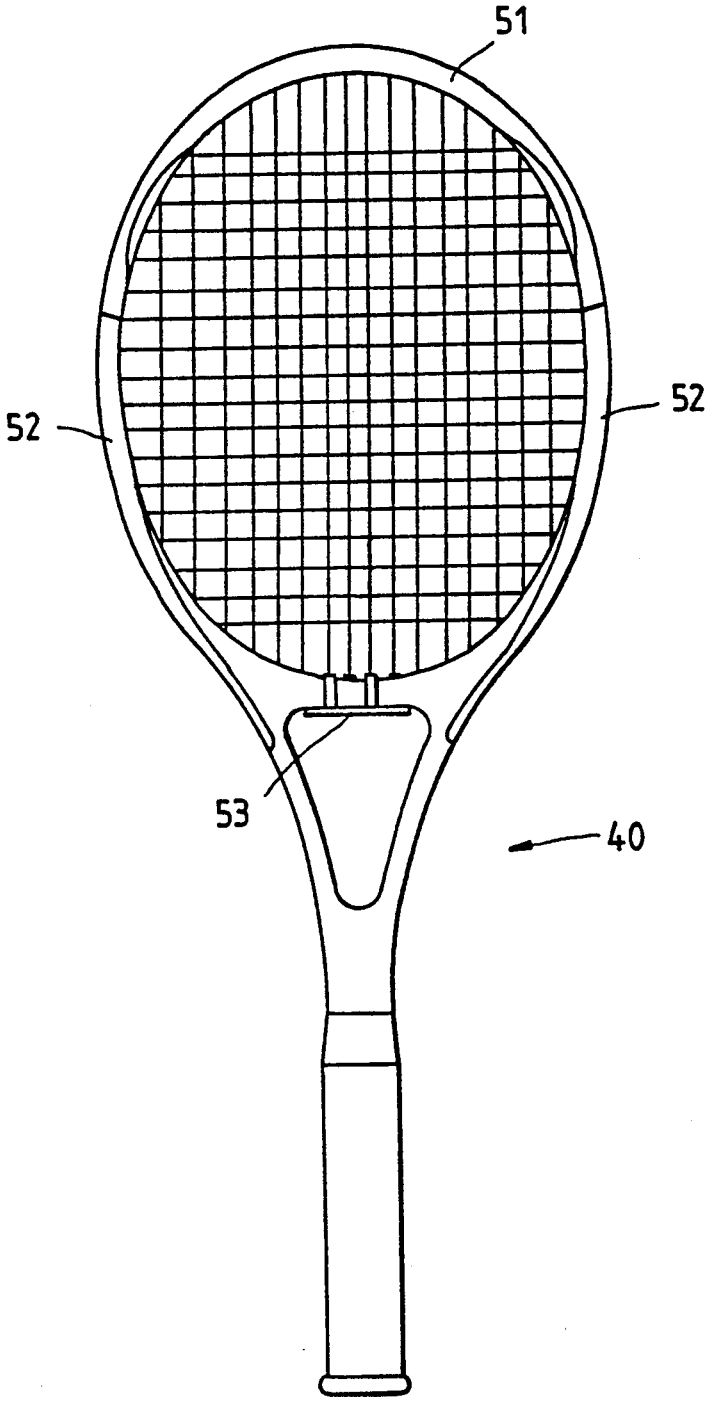
FIG. 17 shows a front elevational view of the second preferred embodiment of the present invention.

As shown in FIGS. 11–16, the racket 40 is provided with a top stringing element 51, two side stringing elements 52, and a bottom stringing element 53. The top stringing element 51 is chosen for illustration. As shown in FIG. 14, the top stringing element 51 has two shoulders 54 parallel to each other. The shoulders 54 are provided at inner sides thereof with stringing tubes 55 and a connection portion 56. Now referring to FIG. 15, the stringing tubes 55' adjacent to both ends of the top stringing element 51 are shown extending downward from the connection portion 56 so as to remain apart from the shoulders 54. The bottom stringing element 53 of plastic material is provided with two stringing tubes 57 extending downward and with a shallow groove 58 located between the two stringing tubes 57, as shown in FIG. 16.

In combination, the top stringing element 51 is disposed at the top portion of the head frame 41, while the bottom stringing element 53 is arranged at the bottom portion of the head frame 41 corresponding to the throat portion of the racket 40. The two side stringing elements 52 are disposed between the bottom stringing element 53 and the top stringing element 51. The stringing tubes 55 and 57 are inserted respectively into the recess cuts 42, while the stringing tubes 55' are fitted into the through holes 43 of the racket 40.

The second preferred embodiment of the present invention described above is different from the first preferred embodiment of the present invention in that its head frame is provided with the through holes located at the positions where the cross strings and the longitudinal strings meet. Such through holes are used to stabilize the stringing tubes inserted thereinto.

Therefore, the game racket of the present invention has advantages over the prior art racket by virtue of the facts that the recess cuts of the head frame are used to receive therein the stringing tubes whose structural integrity is further protected by the wall of the recess cut serving to resist the tension exerting on the string, and that the portions of the strings located at the head frame are shielded by the stringing elements so as to enhance the aesthetic effect of the head frame and to prevent the strings from being damaged when the head frame accidentally hits the ground.

What I claim is:

1. A game racket having improved stringing means comprising a head frame, a hand grip, a shaft located between said head frame and said hand grip, and a netted surface formed by strings stretched horizontally and longitudinally across said head frame having a predetermined number of stringing elements through which said strings pass, each length of the strings which traverses the frame forming two turning points located respectively at two opposite sides of a center line of an outer surface of said head frame in such a manner that a line connecting said turning points intersects said center line obliquely and that said netted surface so formed has a front face and a rear face, wherein said game racket is characterized in that said head frame consists of a predetermined number of recess cuts, and that each of said stringing elements has two shoulders parallel to each other and a predetermined number of stringing tubes, with two of said stringing tubes located respectively and correspondingly on said two shoulders coupled by a connection portion, and further that said stringing elements are disposed in such a manner that said stringing tubes thereof are inserted into said recess cuts and that said connection portion covers the side surface of said head frame.

2. The game racket having improved stringing means according to claim 1 wherein said head frame comprises through holes located respectively at the positions corresponding to one, five, seven, and eleven of the clock.

* * * * *